US008374368B2

(12) United States Patent
Brimhall et al.

(10) Patent No.: US 8,374,368 B2
(45) Date of Patent: Feb. 12, 2013

(54) HEARING AID DEVICE WITH A VOLUME CONTROL

(75) Inventors: Owen D. Brimhall, South Jordan, UT (US); Craig M. Collotzi, Riverton, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 290 days.

(21) Appl. No.: 12/731,905

(22) Filed: Mar. 25, 2010

(65) Prior Publication Data

US 2011/0235834 A1 Sep. 29, 2011

(51) Int. Cl.
*H04R 25/00* (2006.01)

(52) U.S. Cl. ..... 381/314; 381/322; 381/324; 381/328; 381/330

(58) Field of Classification Search ..... 381/314, 381/312, 322, 324, 323, 328–330
See application file for complete search history.

(56) References Cited

U.S. PATENT DOCUMENTS

| | | | | |
|---|---|---|---|---|
| 4,081,782 | A | 3/1978 | Hildreth et al. | |
| 4,598,177 | A * | 7/1986 | McGroarty et al. | 381/323 |
| 4,736,430 | A | 4/1988 | Schroder | |
| 4,922,540 | A * | 5/1990 | Erbe | 381/324 |
| 5,138,665 | A * | 8/1992 | Ito | 381/104 |
| 5,204,917 | A * | 4/1993 | Arndt et al. | 381/324 |
| 5,265,168 | A * | 11/1993 | Schiess et al. | 381/324 |
| 6,041,128 | A * | 3/2000 | Narisawa et al. | 381/322 |
| 7,507,920 | B2 * | 3/2009 | Erbe | 200/14 |
| 2005/0238190 | A1 * | 10/2005 | Rohrlein | 381/312 |
| 2007/0116319 | A1 * | 5/2007 | Hagberg | 381/380 |

FOREIGN PATENT DOCUMENTS

| | | | |
|---|---|---|---|
| EP | 0 004 988 | A1 | 10/1979 |
| EP | 0 188 661 | A1 | 7/1986 |
| EP | 1 496 530 | A2 | 1/2005 |
| EP | 1 973 380 | A1 | 9/2008 |
| FR | 2 360 970 | | 3/1978 |
| WO | WO 2009/120148 | A1 | 10/2009 |

* cited by examiner

*Primary Examiner* — Mohamad Musleh
*Assistant Examiner* — Mangtin Lian
(74) *Attorney, Agent, or Firm* — Birch, Stewart, Kolasch & Birch, LLP

(57) ABSTRACT

A hearing aid is described. The hearing aid includes a control surface and a control element. The hearing aid further includes a plurality of components in addition to the control surface and the control element. A portion of the control surface is configured to engage a portion of the control element. The control surface at least partially circumscribes at least one of the plurality of components.

35 Claims, 6 Drawing Sheets

HEARING AID DEVICE WITH A VOLUME CONTROL

BACKGROUND

Hearing aid devices are used to enhance or improve the quality of life for the user. These devices may amplify certain sounds that have been unheard to some degree by the user in the past. Because each user of a hearing aid has varying degrees of hearing loss, these devices are programmable for adaptation to the user's needs.

Users of hearing aids continue to demand that the size of the hearing aids decrease. A small hearing aid device worn by a user may not be as noticeable to other people. As a result, any reservations the user may have about wearing the device in public may be decreased.

Hearing aid devices may include a shell that carries or houses some of the components required for the device to operate. For example, the shell may carry microphones, a central processing unit (CPU), a battery, etc. As hearing aids decrease in size, it may not be possible to decrease the size of each component that is required for the device to operate.

Further, as hearing aid devices become smaller, controls on the device that interface with the user may also become smaller. These small controls may cause difficulties for a user who desires to actuate these controls because they have become too small. For example, controls used by the user to adjust the volume of sound being output by the hearing aid device have become increasingly small and difficult for a user to actuate. These controls cannot simply increase in size because of the desire to continue producing smaller and smaller hearing aid devices. As a result, benefits may be realized by providing a large control surface for a user to interface with a control element of a hearing aid.

SUMMARY

A hearing aid is described. The hearing aid includes a control surface and a control element. The hearing aid further includes a plurality of components in addition to the control surface and the control element. A portion of the control surface is configured to interface with a portion of the control element. The control surface at least partially circumscribes at least one of the plurality of components.

In one example, the control surface includes a first gear and the control element comprises a second gear. A diameter of the control surface may be greater than a diameter of the control element. In one configuration, a logical component may be configured to determine an effective gear-ratio between a movement of the control surface and a movement of the control element with firmware.

The control surface may circumscribe a battery that provides power to a hearing aid device. The control element may adjust a volume of sound being output from a loudspeaker of a hearing aid device. In one embodiment, the control element may be configured to change a programmed setting of a hearing aid device.

The control surface and the control element may rotate approximately 360° around an axis in a clockwise direction or a counter-clockwise direction. The control surface may rotate less than approximately 360° around an axis in a clockwise direction or a counter-clockwise direction. In one example, the control surface may include a rack-and-pinion mechanism. In one configuration, the control element may include a sensor to detect movements of the control surface.

A hearing aid device is also described. The device includes a first component and a second component. A connecting apparatus is configured to connect the first component to the second component. The first component may include a control surface and a control element. The first component may also include a plurality of components in addition to the control surface and the control element. A portion of the control surface may be configured to engage a portion of the control element. The control surface at least partially circumscribes at least one of the plurality of components.

In one embodiment, the control surface may prevent moisture from contacting the at least one of the plurality of components. The control surface may displace moisture from the hearing aid device via a trench.

A hearing aid device is further described. The device may include a control surface that includes a tab portion extending from a peripheral surface of the control surface, and a control element. The device may also enclose or circumscribe a plurality of components in addition to the control surface, and the control element. A portion of the control surface may be configured to engage a portion of the control element. The control surface may at least partially circumscribe at least one of the plurality of components.

In one embodiment, the peripheral surface of the control element may include a smooth portion. A plurality of extensions may extend outwardly from a portion of the smooth portion of the peripheral surface. In addition, the peripheral surface may include a plurality of indentations. In one embodiment, an indentation is formed between adjacent extensions. The plurality of extensions on the peripheral surface of the control surface may be configured to engage a plurality of indentations formed between adjacent extensions on a peripheral surface of the control element. The control element may be configured to adjust a volume of sound being output from a loudspeaker or receiver of the hearing aid device.

A hearing aid is further described. The hearing aid may include a control surface and a control element. The hearing aide may further include a plurality of components in addition to the control surface and the control element. A portion of the control surface may be configured to engage a portion of the control element to adjust one or more characteristics of the hearing aid. The adjustment of the characteristics of the hearing aid may be controlled by one or more of the plurality of components.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
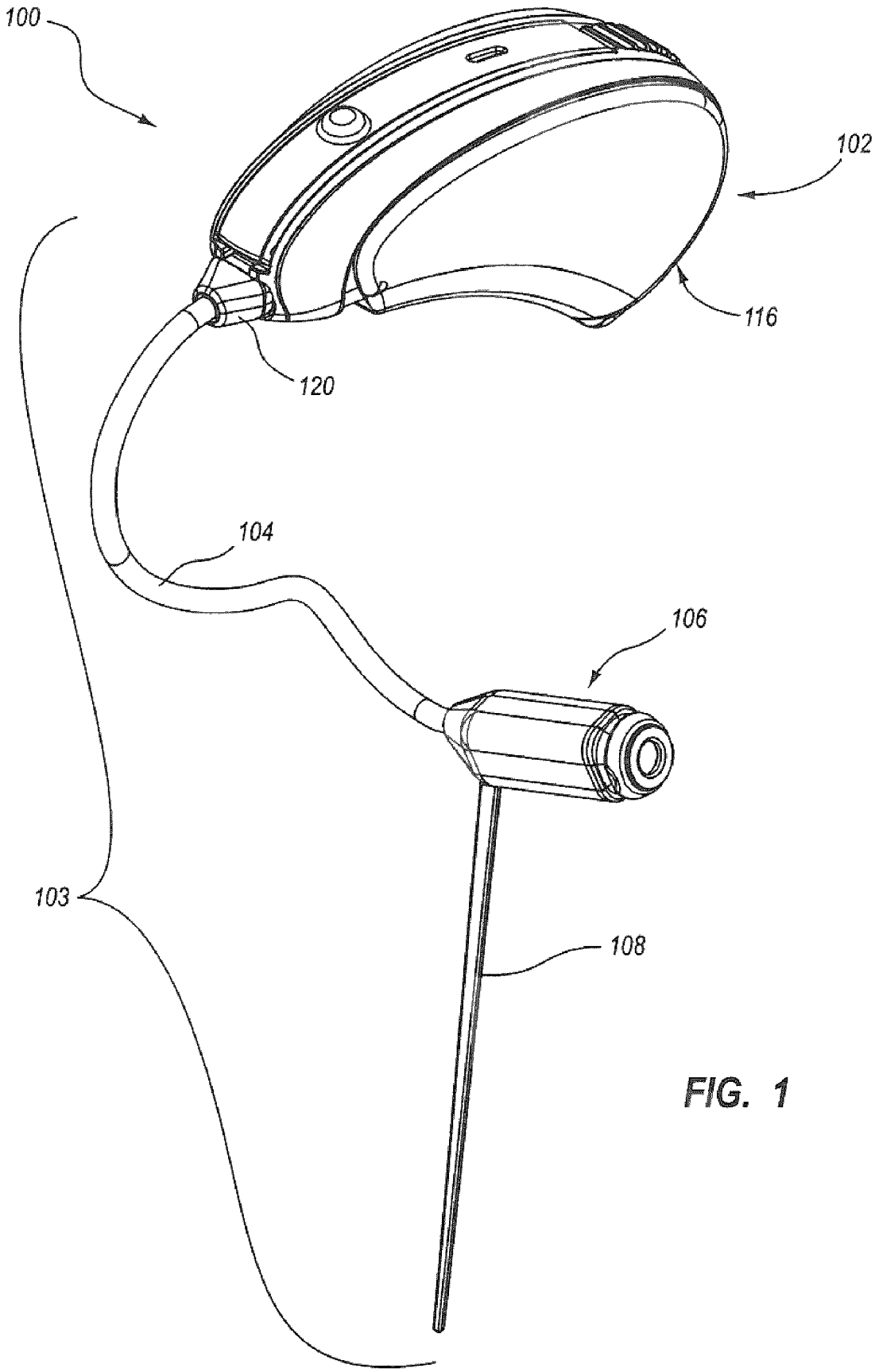
FIG. 1 illustrates an embodiment of a hearing aid device.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

Hearing aids are designed to amplify and filter sounds for the wearer. A user may adjust the level of sound amplification (i.e., volume) according to his/her preference. In one example, hearing aids may include a volume control. As hearing aids become smaller, it may be difficult for a user to actuate a small volume control. The present hearing aid described herein provides a relatively large volume control for smaller hearing aids. In one embodiment, the volume control may be a wheel or gear with an interior space. The wheel or gear may rotate and circumscribes other non-volume control components within the interior space.

FIG. 1 illustrates one embodiment of a hearing aid device 100. The hearing aid device 100 may be any type of device, such as, but not limited to, a behind-the-ear (BTE), a receiver-in-canal (RIC), a completely-in-canal (CIC), a mini-canal (MC), an in-the-canal (ITC), a half-shell (HS), an in-the-ear (ITE), and the like. In one embodiment, the device 100 may include a case 102. The case 102 may be placed behind the pinna (i.e., outer portion of the ear) of the user. The case 102 may hold various electrical components that perform sound amplification. In one embodiment, the case 102 may include a covering 116 in order to cover a portion of the case 102.

In one configuration, the case 102 may be connected to a receiver assembly 103. The receiver assembly 103 may include a receiver-assembly connector 120, a connecting tube 104, an insertion component 106, and a retention device 108. The insertion component 106 may be placed directly in the user's ear canal. In one embodiment, the insertion component 106 may include a receiver and loudspeaker to process and output sound into the user's ear canal. In another embodiment, some or all of the components of the insertion component 106 may be placed within the case 102 in order to process sounds and output the sounds to a user wearing the device 100. The processed sounds may be passed through an open hollow tube (such as the connecting tube 104) and into the user's ear canal. In this embodiment, an acoustic coupling may be attached to the insertion component 106 and placed in the user's ear. The acoustic coupling may be an ear mold that fits in the user's ear. As another example, the coupling may be a dome-shaped component that may be placed in the user's ear.

Figure 2A:
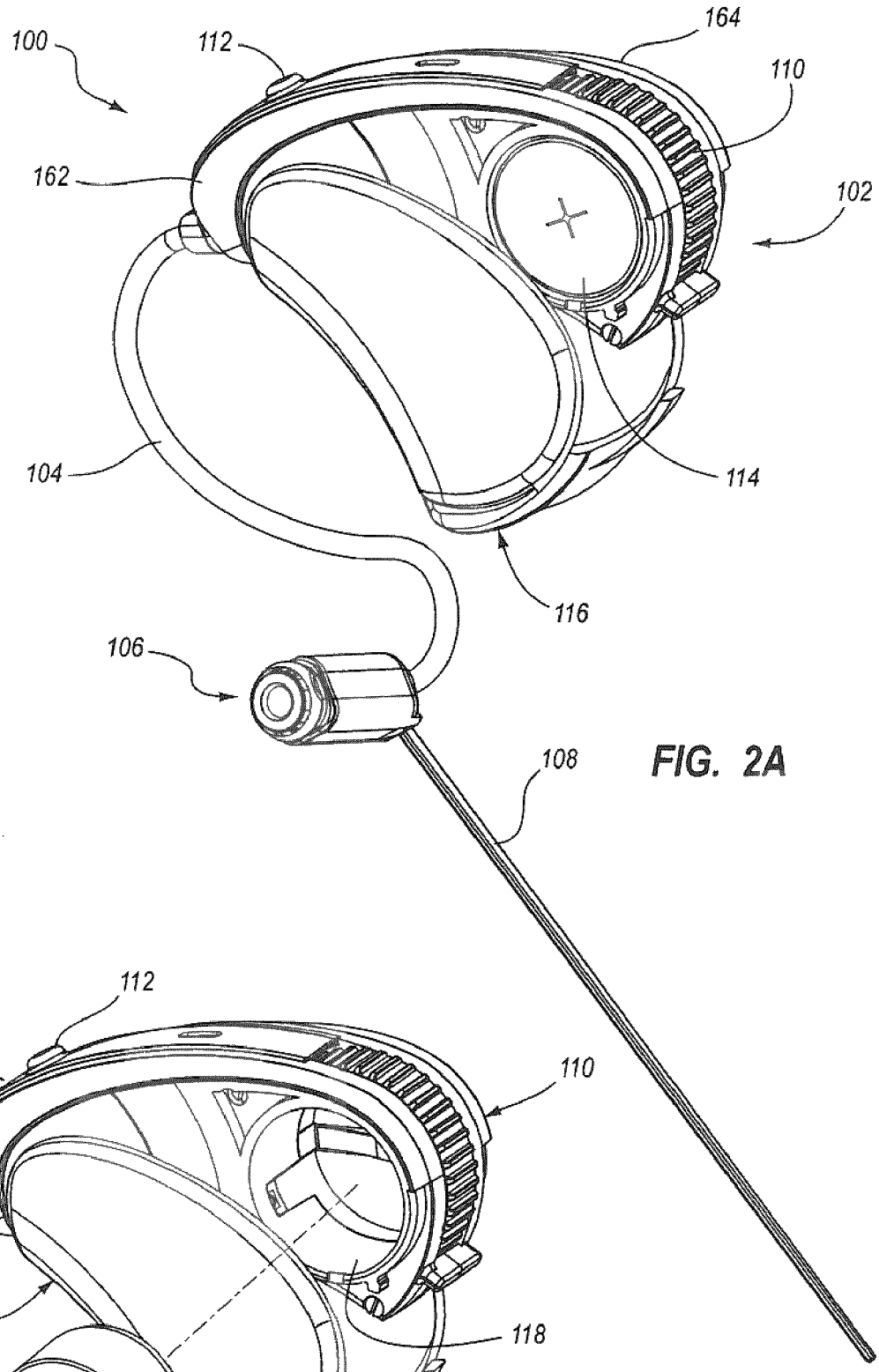
FIG. 2A is another illustration of the hearing aid device of FIG. 1.

FIG. 2A is another illustration of the hearing aid device 100. As illustrated, the case 102 may include a battery 114 to provide power to the hearing aid device 100. In one configuration, the case 102 may include a first panel 162 and a second panel 164. The first panel 162 may connect to the second panel 164 in order to form the case 102. Electrical components may be housed within the case 102 between the first panel 162 and the second panel 164.

The case 102 may also include a push button 112. The push button 112 may be cylindrically shaped and provide an interface functionality to the user of the hearing aid 100. For example, the user may actuate the button 112 (e.g., depressing the push button 112) in order to initiate a certain function of the hearing aid 100. These functions may include selecting a particular configuration of the hearing aid device 100.

In addition, the case 102 may include a control surface 110. In one example, the control surface 110 may be a wheel or gear that circumscribes one or more electrical components housed within the case 102. For example, the control surface 110 may circumscribe the battery 114. In one embodiment, a user may interface with the control surface 110 in order to control certain functions of the hearing aid 100.

The control surface 110 may be positioned at a distal end of the case 102, at a proximal end of the case 102, in a central location of the case 102, and the like. In other words, the control surface 110 may be positioned at any location on the case 102. In one embodiment, the control surface 110 may be tactile and disproportionately large in comparison to the overall size of the hearing aid device 100. The control surface 110 may be adjusted via rotation, translation, lateral movement, etc.

Figure 2B:
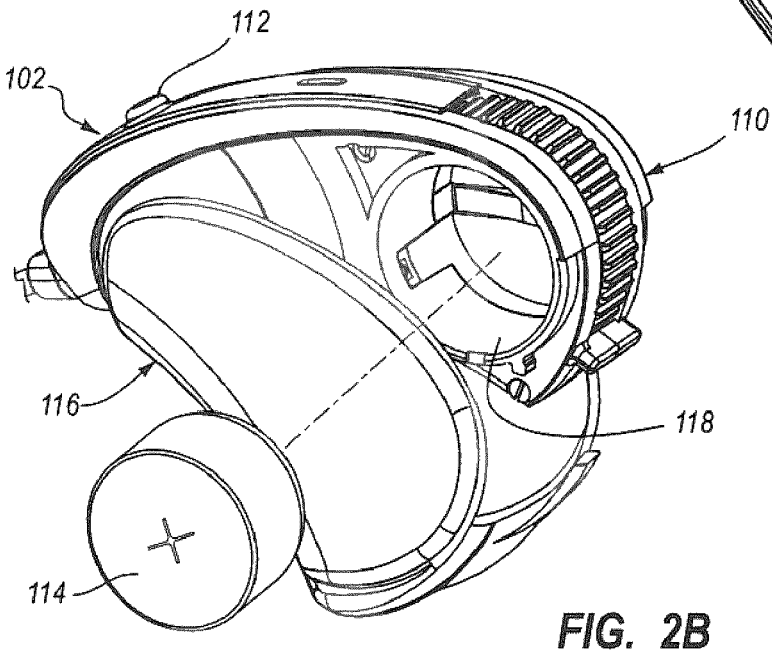
FIG. 2B is a partially exploded view of a case of the hearing aid device of FIG. 1.

FIG. 2B illustrates one embodiment of the case 102. As previously mentioned, the case 102 may include the push button 112, the control surface 110, and the covering 116. As illustrated, the position of the covering 116 may be adjusted to expose a chamber 118. One or more components, such as the battery 114, may be placed within the chamber 118. In another embodiment, other components may be placed within the chamber 118 instead of, or in addition to, the battery 114. In one example, the control surface 110 may circumscribe the chamber 118 and the one or more electrical components housed within the chamber 118. The chamber 118 illustrated in FIG. 2B is circular, but the chamber 118 may be any shape or size in order to house the one or more components.

Figure 3:
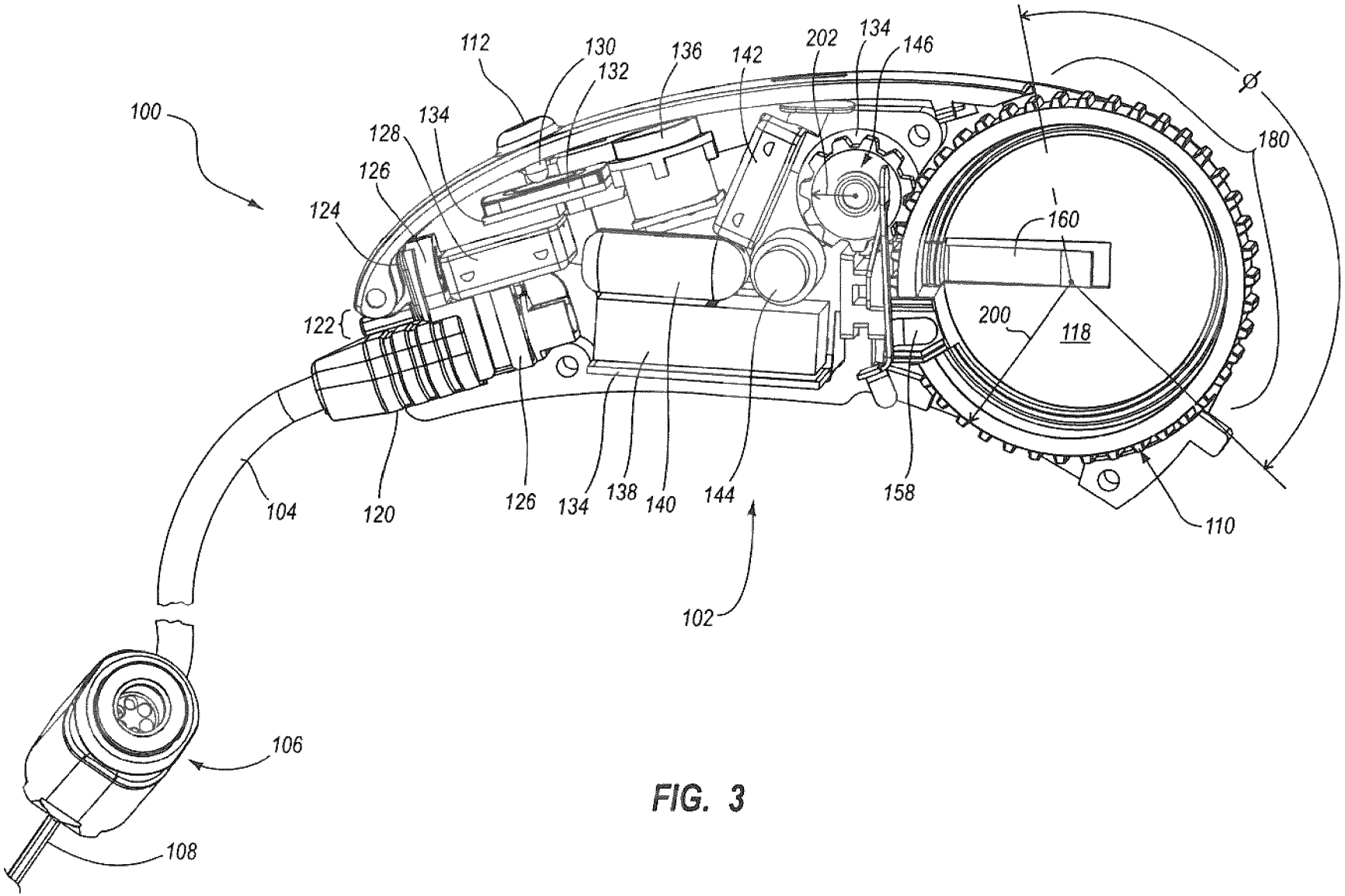
FIG. 3 is a partial illustration of the hearing aid device of FIG. 1.

FIG. 3 is a partial illustration of the hearing aid device 100. The device 100 includes the case 102 and the insertion component 106. The connecting tube 104 may connect the case 102 and the insertion component 106. In one example, the case 102 may include various electrical components. For example, the component 102 may include a circuit board 134 that connects to one or more electrical components. In one embodiment, a central processing unit (CPU) 138, a programming connector 136, a momentary-contact switch 132, and a control element 146 may be connected to the circuit board 134.

In one embodiment, the control surface 110 and the control element 146 may interface with each other via gears, wheels, trackballs, or in any other suitable manner. The coupling of the control surface 110 and the control element 146 may be electrical, mechanical, optical, etc. In one configuration, actuation of the control surface 110 may actuate the control element 146. The control element 146 may be actuated in order to control various functions of the hearing aid device 100. Example of these functions may include, but are not limited to, controlling hearing aid parameters such as volume, gain, frequency response, frequency compression, amplitude compression, noise reduction, program selection, ON/OFF functions, time constants, and the like. The control element 146 may control hearing aid parameters as a function of resistance, capacitance, inductance, etc. associated with the control element 146.

The control element 146 may be a wheel, gear, potentiometer, switch, etc. In one embodiment, the control element 146 may be smaller than the control surface 110. For example, the control element 146 may have a diameter that is less than the diameter of the control surface 110. In one example, a control surface radius 200 may be in the range of approximately 0.15 inches to approximately 0.3 inches, and more preferably in the range of approximately 0.2 inches to approximately 0.25 inches. A control element radius 202 may be in the range of approximately 0.05 inches to approximately 0.08 inches, and more preferably in the range of approximately 0.06 inches to approximately 0.07 inches. As a result, the use of the control surface 110 and the control element 146 may perform motion multiplication (or division) or a direct transformation.

In one configuration, a first terminal connector 158 may be positioned proximate to the chamber 118 for housing electrical components. The chamber 118 may also include a second terminal connector 160. In one embodiment, the battery 114 may be placed in the chamber 118. A first terminal of the battery 114 may contact the first terminal connector 158 and a second terminal of the battery 114 may be in contact with the second terminal connector 160. The control surface 110 may circumscribe the chamber 118 and electrical components that may be housed within the chamber 118.

In one example, a user may interface with the control surface 110 via an access area 180. The access area 180 may include an exposed portion of the control surface 110 that is not covered by a portion of the case 102. In one example, the access area 180 may include an angle of rotation (Ø) in the range of approximately 30 degrees to approximately 245 degrees, and more preferably in the range of approximately 100 degrees to approximately 170 degrees. In another example, the angle of rotation (Ø) of the access area 180 may be in the range of approximately 0.1 inches to approximately 0.7 inches, and more preferably in the range of approximately 0.3 inches to approximately 0.5 inches.

In one embodiment, the access area 180 may be defined as an area formed by the connection of the first panel 162 and the second panel 164. The access area 180 may expose the control surface 110 so that a user may access or contact the control surface 110 outside of the panels 162, 164. The access area 180 may be an area that permits certain movement of the control surface 110. Examples of movement may include, but are not limited to, the position, velocity, acceleration, and the like of the control surface 110. The user may adjust or move the control surface 110 within the access area 180 by interfacing with the portion of the control surface 110 that is exposed within the access area 180.

In one configuration, the user may rotate the control surface 110 around an axis that is perpendicular to the surface of the chamber 118. The control surface 110 may partially or fully rotate around the axis. The control surface 110 may also slide from a first position to a second position. The control surface 110 may rotate freely. In another embodiment, the actuation of the control surface 110 may generate tactile clicks that may be detected by the user. In one embodiment, rotating the control surface 110 may create an audible signal. For example, the user may hear an audible clicking noise as the control surface 110 is actuated. In one example, the control surface 110 and the control element 146 may be gears. In one embodiment, the control surface 110 may engage (or mate) with the control element 146.

In one example, an effective gear ratio between the control surface 110 and the control element 146 may be generated logically that indicates the amount of movement of the control surface 110 that will generate a particular result from the actuation of the control element 146. As previously explained, the size of the control surface 110 may be larger than the size of the control element 146. As a result, when a user moves, rotates, etc. the control surface 110 a certain degree, the control element 146 may also move, rotate, etc. However, the rotation angle of the control element 146 may be greater than the rotation angle of the control surface 110. This may produce undesirable results. For example, if the control element 146 controls the volume of the hearing aid output, a small rotation of the control surface 110 may cause a large rotation of the control element 146, which may increase or decrease the volume more than the desired amount. The logical gear ratio may be generated to indicate the ratio between movements of the control surface 110 and the control element 146. For example, the logical gear ratio may indicate that a full rotation of the control surface 110 corresponds to a ¼ rotation of the control element 146.

In addition, the logical gear ratio may indicate a ratio of effective rotations of the control element 146 to the actual rotations of the control element 146. For example, the gear ratio may indicate that two actual rotations of the control element 146 may produce an change in volume corresponding to a single rotation of the control element 146. As another example, the ratio may indicate that four actual rotations of the control element 146 may produce a change in volume corresponding to a single rotation of the control element 146. The logical gear ratio may be determined and implemented by firmware, state machines, counting mechanisms, and the like.

The case 102 may also include an antenna 144 and a telecoil 140. The case 102 may also include one or more microphones 128, 142. In one example, the microphones 128, 142 may be directional microphones that amplify sounds originating from a certain direction. For example, sounds originating from the direction the user of the hearing aid 100 is facing may be amplified more than sounds from behind the user. A connecting apparatus 126 may connect to the receiver-assembly connector 120, which may connect to the connecting tube 104. A first microphone membrane 124 may be placed adjacent to the connecting apparatus 126 that may be proximate to the first microphone 128. In one embodiment, a sound gap 122 may be formed between a portion of the case 102 and the receiver-assembly connector 120. Sound may enter the case 102 via the sound gap 122.

Figure 4:
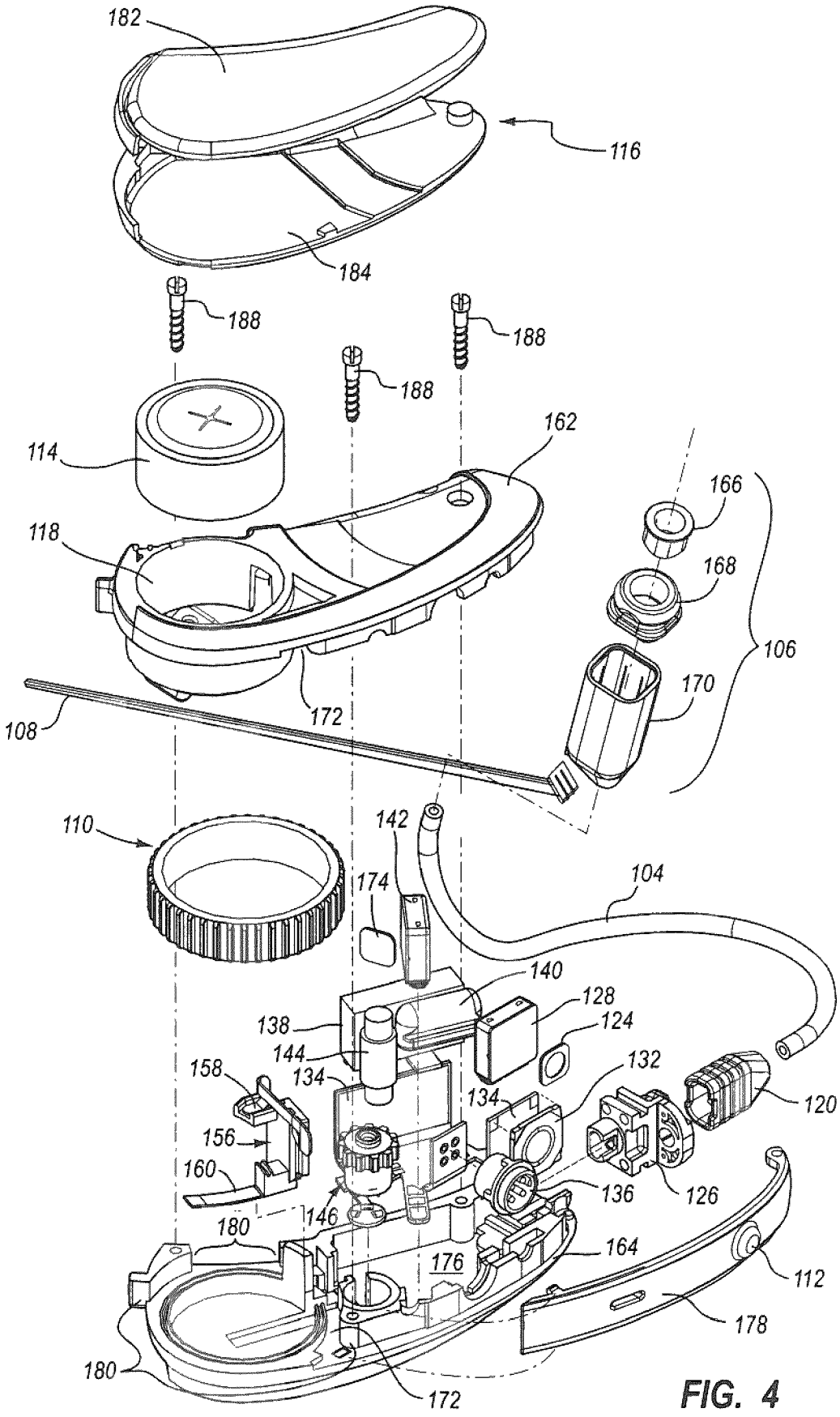
FIG. 4 is an exploded view of the hearing aid device of FIG. 1.

FIG. 4 is an exploded view of the hearing aid 100. The exploded view illustrates some of the internal and external components of the hearing aid 100.

As mentioned previously, the hearing aid 100 may include the case 102 and the insertion component 106. In one embodiment, the case 102 may include the first panel 162 and the second panel 164. The panels 162, 164 may be connected or attached by one or more screws or other fasteners 188. The first panel 162 may include the chamber 118 that houses or holds one or more electrical components of the hearing aid 100. In one example, the chamber 118 may hold the battery 114 that may provide power to the hearing aid 100.

The control surface 110 may be placed on either the first panel 162 or the second panel 164 so that the control surface 110 circumscribes the components held within the chamber 118. When the first panel 162 is connected to the second panel 164, a user may interface with the control surface 110 via the access area 180. In one embodiment, the control surface 110 may be a relatively large wheel or gear. For example, the control surface 110 may be circular in shape and may have a diameter in the range of approximately 0.3 inches to approximately 0.6 inches, and more preferably in the range of approximately 0.4 inches to approximately 0.5 inches. The control surface 110 and the access area 180 may be relatively large compared to the overall size of the hearing aid 100. A large control surface 110 with a large access area 180 may make it easier for users to use. In particular, users who may be more advanced in age with limited tactile functionality may be able to use, manipulate, and control the control surface 110 with less difficulty than control elements that are smaller in size.

The combination of the first panel 162 and the second panel 164 may form a trench 172 or a tunnel. Additional electrical components may be placed in a component holding area 176 of the second panel 164. These elements, along with the components held within the chamber 118, may be sealed off and protected from moisture or other elements that may enter the trench 172. For example, when the control surface 110 is positioned within the second panel 164, the surface 110 may seal off or protect components within the chamber 118. Similarly, when the first panel 162 is connected to the second panel 164, the components within the holding area 176 may also be sealed off or protected from moisture or other elements that may be harmful to the components. In one example, moisture (e.g., sweat, water, condensation, etc.) may exist on a portion of the control surface 110. As the surface 110 is adjusted (e.g., rotated, moved, displaced, etc.), the moisture may be displaced from the control surface 110 and exit the case 102 via the trench 172.

In one configuration, the circuit board 134 may be placed within the component holding area 176. The antenna 144, the CPU 138, and the telecoil 140 may be attached or connected to the circuit board 134. In addition, the first microphone 128 and the second microphone 142 may also be connected or attached to the circuit board 134. Further, the programming connector 136 and the momentary-contact switch 132 may be connected to the circuit board 134. The circuit board 134, together with the attached or connected electrical components, may be placed within the component holding area 176.

The connector apparatus 126 may also be placed within a portion of the second panel 164. The connector apparatus 126 may connect to the receiver-assembly connector 120. The receiver-assembly connector 120 may connect to a first end of the connector tube 104. A second end of the connector tube 104 may connect to a receiver box 170 that is part of the insertion component 106. A cap 168 may be connected to the receiver box 170, and a wax guard 166 may be connected to the cap 168. In one embodiment, the wax guard 166 may prevent debris, earwax, or other material from entering the receiver box 170. In one configuration, a loudspeaker may be held within the receiver box 170. The loudspeaker or receiver box 170 may output sound into the user's ear canal. The retention device 108 may be connected or attached to the receiver box 170.

In one configuration, the first microphone 128 and the second microphone 142 may be connected to the circuit board 134. Each microphone 128, 142 may be associated with a microphone membrane 124, 174. Further, a cover 178 may be connected to the second panel 164 in order to protect and cover the various components held within the components holding area 176.

The covering 116 may include a first covering wall 182 and a second covering wall 184. The first covering wall 182 may cover a portion of the first panel 162 and the second covering wall 184 may cover a portion of the second panel 164.

Figure 5:
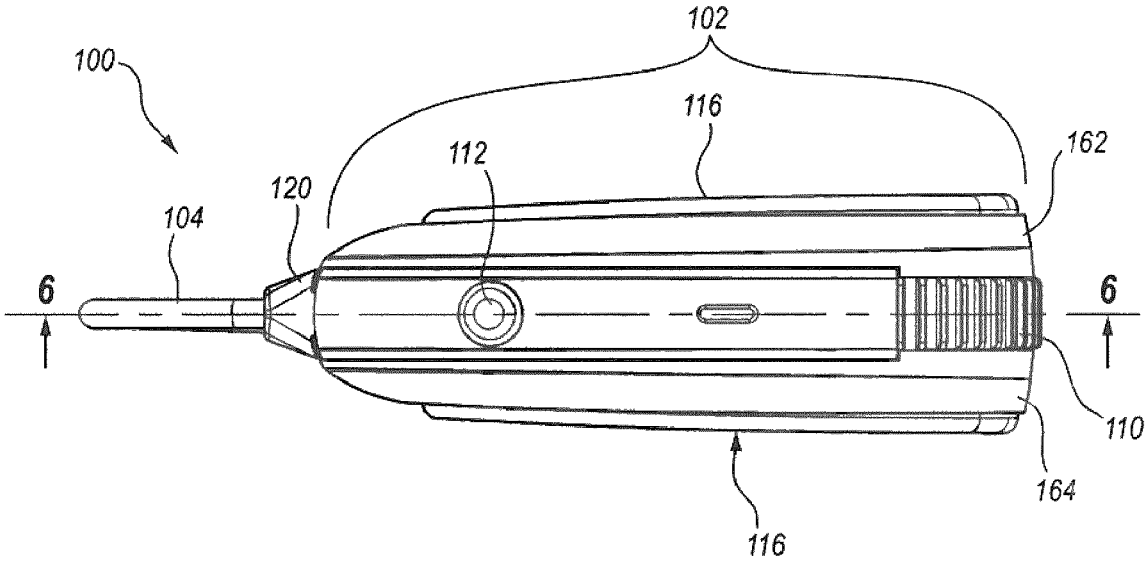
FIG. 5 is a top view of the case of FIG. 2B.

FIG. 5 is a top view of the case 102. As illustrated, the case 102 may include the push button 112 and the control surface 110. The case 102 may also include the first panel 162 and the second panel 164. The case 102 may also include the covering 116.

Figure 6:
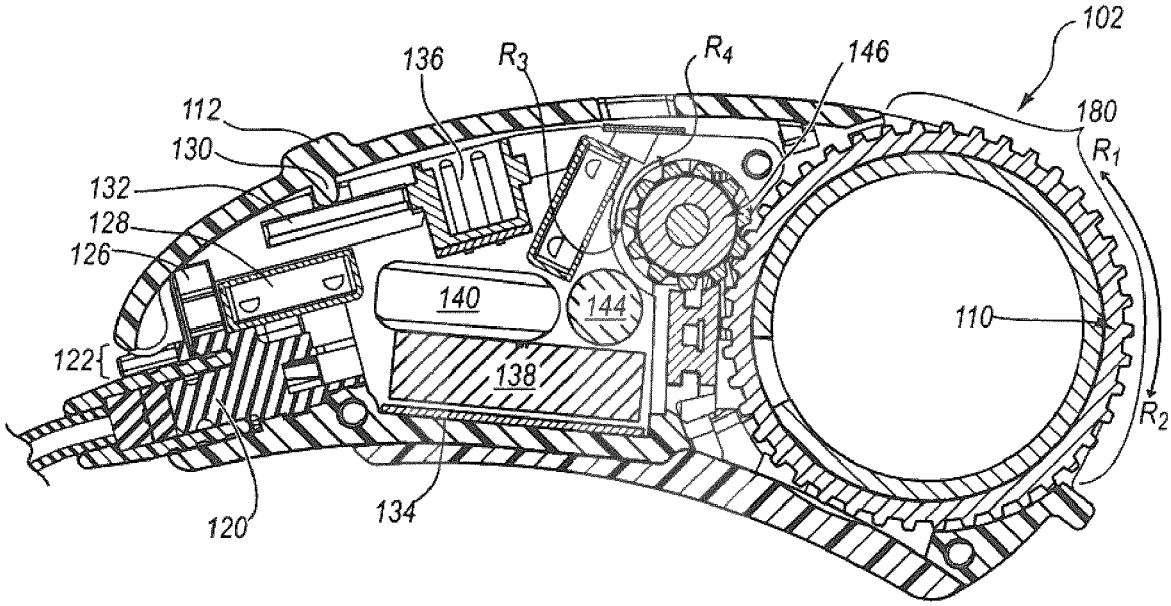
FIG. 6 is a cross-section view of the case of FIG. 5 taken along indicators 6-6.

FIG. 6 is a cross-section view of the case 102. As previously explained, the case 102 may include various components and structures for the hearing aid device 100.

In one configuration, the case 102 may include the control surface 110. In one example, the control surface 110 may be circular-shaped, like a wheel or a gear. In one configuration, the control surface 110 may be a gear of a first radius from a central axis. The control surface 110 may have a constant diameter.

Also illustrated in the case 102 is the control element 146. The control element 146 may be circular-shaped, like a wheel or a gear. The diameter of the second control 146 may be smaller than the diameter of the control surface 110. For example, the diameter of the control element 146 may be in the range of approximately 0.1 inches to approximately 0.16 inches, and preferably in the range of approximately 0.12 inches to approximately 0.14 inches. In one embodiment, the control surface 110 may engage the control element 146.

In another embodiment, the surfaces of the control surface 110 and the control element 146 may be smooth. The smooth surfaces may include a high friction characteristic or material, such as rubber, so that the surface of the control surface 110 and the surface of the control element 146 may interface and engage one another because of the high friction characteristics. In one embodiment, magnetism or magnetic induction may also be used to cause the movement between the control surface 110 and the control element 146. In one configuration, the Hall effect may be used to sense movement between the control surface 110 and the control element 146. In other embodiments, the control element 146 may remain stationary. For example, the control element 146 may be an optical sensor that detects movement by the control surface 110. The control element 146 may also detect movement by the control surface 110 via capacitive sensors, contacts, resistive sensors, switches, and the like.

In one example, a user may interface with the control surface 110 via the access area 180. For example, a user may rotate the control surface 110 in a clockwise direction, $R_1$. While the control surface 110 is rotating in the clockwise direction, $R_1$, the control element 146 may rotate in a counter-clockwise direction, $R_4$. Similarly, the user may rotate the control surface 110 in a counter-clockwise direction, $R_2$. As a result, the control element 146 may rotate in a clockwise direction, $R_3$.

As the control surface 110 engages or interfaces with the control element 146, various functions of the hearing aid 100 may be affected. In one example, the interface between the control surface 110 and the control element 146 may affect the volume of sound being output from the insertion component 106 into the user's ear canal. For example, the user may rotate the control surface 110 in the clockwise direction, $R_1$, which may cause the control element 146 to rotate in the counter-clockwise direction, $R_4$, which may decrease the volume of sound exiting the insertion component 106. Similarly, the user may rotate the control surface 110 in the counter-clockwise direction, $R_2$, which may cause the control element 146 to rotate in the clockwise direction, $R_3$, which may increase the volume of the sound being output from the insertion component 106. As a result, the control surface 110, that may be larger than the control element 146, may provide the large access area 180 so that the user may alter certain functions of the hearing aid 100, such as increasing or decreasing the volume of sound exiting the insertion component 106 into the user's ear canal.

As previously explained, the control surface 110 may circumscribe various electrical components of the case 102. For example, the control surface 110 may circumscribe the battery 114, contacts, electronics, transducers, structural elements, or any other electrical component associated with the hearing aid device 100. In one example, the control surface 110 may circumscribe the control element 146 and/or other electrical components associated with the hearing aid device 100.

Figure 7:
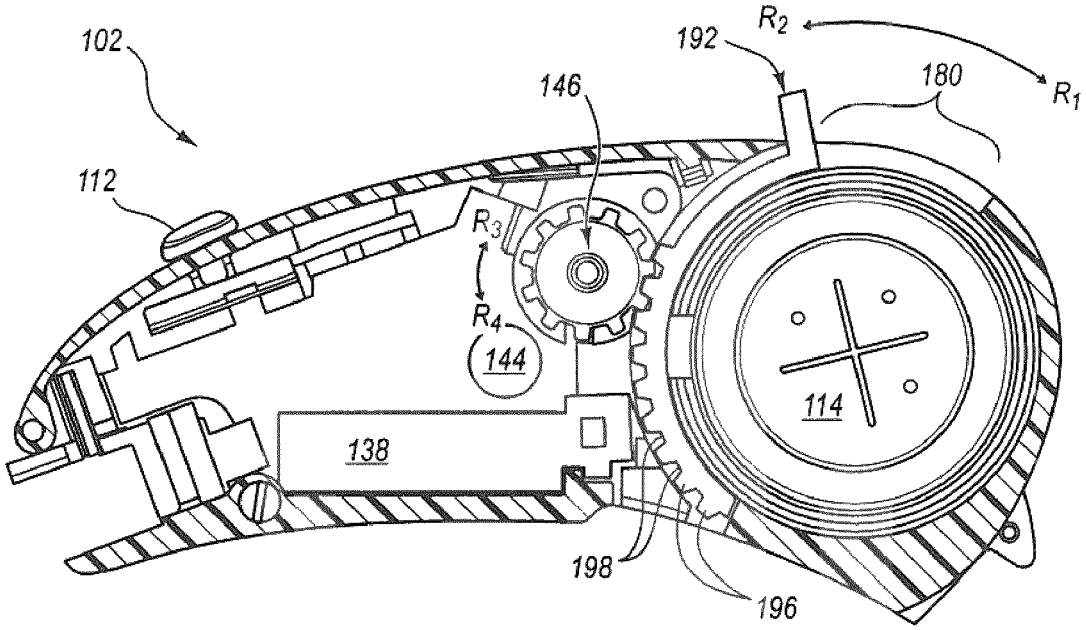
FIG. 7 is a cross-sectional view of another embodiment of a case having a tab control in a first position.

FIG. 7 is another embodiment of a case 102 that includes a control surface with a tab 192 and the control element 146. The tab 192 may be movable between various rotated positions. FIG. 7 shows the tab 192 in a first position. The control surface with the tab 192 may be a rack-and-pinion mechanism.

In one configuration, the tab 192 may partially surround the battery 114 or other components of the case 102. In one example, the tab 192 may move in the clockwise direction, $R_1$, or in the counter-clockwise direction, $R_2$. A user may access the tab 192 in order to move the tab 192 within the access area 180. The tab 192 may include a smooth surface 194, extensions 196, and indentations 198. The extensions 196 may extend outwardly from the surface 194, and the indentations 198 may be formed between two consecutive extensions 196.

In one configuration, the indentations 198 may engage or mate with the control element 146. For example, the tab 192 may be moved in the direction $R_1$. As a result, the engagement of the extensions 196 and indentations 198 with the control element 146 may cause the control element 146 to rotate in the direction $R_4$. In one embodiment, the movement of the control element 146 may alter certain functions of the hearing aid device 100. For example, movements of the control element 146 may increase or decrease the volume being output from the insertion component 106 that is placed in the user's ear canal.

Figure 8:
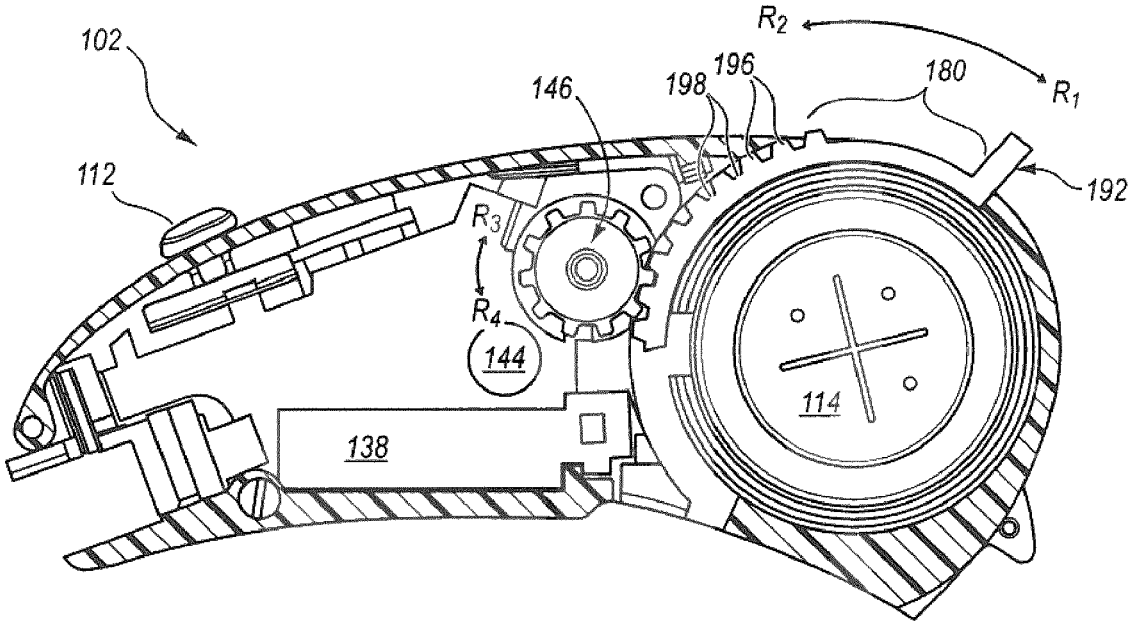
FIG. 8 is a cross-sectional view of the case of FIG. 7 with the tab control in a second position.

FIG. 8 is one embodiment of the case 102 with the tab 192 in a second position. In one embodiment, the tab 192 may be in the second position after a user has moved the tab 192 in the direction $R_1$. As illustrated, movement of the tab 192 in the directions $R_1$ and $R_2$ may cause the indentations 198 and extensions 196 of the tab 192 to continuously engage the control element 146. In other words, as the tab 192 moves in the direction $R_1$, the control element 146 may move in the direction $R_4$. Similarly, as the tab 192 moves in the direction $R_2$, the control element 146 may move in the direction $R_3$. The movement of the control element 146 may affect certain functions of the hearing aid 100. Examples of these functions may include, but are not limited to, radio frequency, amplitude compression, frequency response, noise reduction, frequency compression, etc. Further, the movement of the control element 146 may cause the volume being output at the insertion component 106 to be increased or decreased.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising."

What is claimed is:

1. A hearing aid, comprising:
a control surface;
a control element having a wheel shape, configured to mechanically engage the control surface and to adjust one or more characteristics of the hearing aid; and
a plurality of components in addition to the control surface and the control element, wherein
a portion of the control surface is configured to mechanically engage with a portion of the control element,
the control surface at least partially circumscribes at least one of the plurality of components, and
rotation of the control surface over a first rotation angle causes the control element to rotate over a second rotation angle greater than the first rotation angle.

2. The hearing aid of claim 1, wherein
the control surface comprises a first gear and the control element comprises a second gear.

3. The hearing aid of claim 1, wherein
a diameter of the control surface is greater than a diameter of the control element.

4. The hearing aid of claim 2, further comprising
a logical component configured to determine a logical gear-ratio between a movement of the control surface and a movement of the control element.

5. The hearing aid of claim 1, wherein
the control surface is configured to circumscribe a battery that provides power to a hearing aid device.

6. The hearing aid of claim 1, wherein
the control element is configured to adjust a volume of sound being output from a loudspeaker of a hearing aid device.

7. The hearing aid of claim 1, wherein
the control element is configured to change a programmed setting of a hearing aid device.

8. The hearing aid of claim 1, wherein
the control surface and the control element are configured to rotate approximately 360° around an axis in a clockwise direction or a counter-clockwise direction.

9. The hearing aid of claim 1, wherein
the control element is a sensor configured to detect movements of the control surface.

10. The hearing aid according to claim 1, further comprising:
a hollow ring, wherein
the control surface is an outermost surface of said hollow ring.

11. The hearing aid according to claim 1, further comprising:
a casing including
a first panel, and
a second panel positioned opposite the first panel, wherein
the control surface is configured to rotate in place supported by said casing.

12. The hearing aid according to claim 11, further comprising:
a covering configured to externally cover the first panel and the second panel of said casing.

13. The hearing aid according to claim 12, wherein
the covering includes a protrusion mating with a depression in the casing, the protrusion mated with the depression defining a rotation axis, and
the casing is configured to rotate around said rotation axis relative to the covering.

14. The hearing aid according to claim 13, wherein
the rotation axis is located at a first distal end of the casing, and
the control surface is located at a second distal end of the casing, opposite from the first distal end.

15. A hearing aid device, comprising:
a first component;
a second component; and
a connecting apparatus configured to connect the first component to the second component, wherein
the first component includes
a control surface,
a control element having a wheel shape, configured to mechanically engage the control surface and to adjust one or more characteristics of the hearing aid device, and
a plurality of components in addition to the control surface and the control element,
a portion of the control surface is configured to mechanically engage a portion of the control element,
rotation of the control surface over a first rotation angle causes the control element to rotate over a second rotation angle greater than the first rotation angle, and
the control surface at least partially circumscribes at least one of the plurality of components.

16. The hearing aid device of claim 15, wherein
the control surface comprises a first gear and the control element comprises a second gear.

17. The hearing aid device of claim 15, wherein
a diameter of the control surface is greater than a diameter of the control element.

18. The hearing aid device of claim 16, further comprising
a logical component to determine a logical gear-ratio between a movement of the control surface and a movement of the control element.

19. The hearing aid device of claim 15, wherein
the control surface is configured to circumscribe a battery that provides power to the hearing aid device.

20. The hearing aid device of claim 15, wherein
the control element is configured to adjust a volume of sound being output from a loudspeaker of the hearing aid device, wherein
the loudspeaker is located in the second component.

21. The hearing aid device of claim 15, wherein
the control element is configured to change a programmed setting of the hearing aid device.

22. The hearing aid device of claim 15, wherein
the control element is a sensor configured to detect movements of the control surface.

23. The hearing aid device of claim 15, wherein
the control surface is further configured to prevent moisture from contacting the at least one of the plurality of components.

24. The hearing aid device of claim 23, wherein
the control surface is further configured to displace moisture from the hearing aid device via a trench.

25. The hearing aid device according to claim 15, further comprising:
a casing including
a first panel, and
a second panel positioned opposite the first panel, wherein
the control surface is configured to rotate in place supported by said casing.

26. The hearing aid device according to claim 25, further comprising:
a covering configured to externally cover the first panel and the second panel of said casing.

27. The hearing aid device according to claim 26, wherein
the covering includes a protrusion mating with a depression in the casing, the protrusion mated with the depression defining a rotation axis, and
the casing is configured to rotate around said rotation axis relative to the covering.

28. The hearing aid device according to claim 27, wherein
the rotation axis is located at a first distal end of the casing, and
the control surface is located at a second distal end of the casing, opposite from the first distal end.

29. The hearing aid device according to claim 27, wherein
the connecting apparatus is connected to a first distal end of the casing, and
the control surface is located at a second distal end of the casing, opposite from the first distal end.

30. A hearing aid, comprising:
a control surface;
a control element having a wheel shape, configured to mechanically engage the control surface and to adjust one or more characteristics of the hearing aid; and
a plurality of components in addition to the control surface and the control element, wherein
a portion of the control surface is configured to mechanically engage a portion of the control element to adjust said one or more characteristics of the hearing aid,
the adjustment of the characteristics is controlled by one or more of the plurality of components, and
rotation of the control surface over a first rotation angle causes the control element to rotate over a second rotation angle greater than the first rotation angle.

31. The hearing aid according to claim 30, further comprising:
a hollow ring, wherein
the control surface is an outermost surface of said hollow ring.

32. The hearing aid according to claim 30, further comprising:
a casing including
a first panel, and
a second panel positioned opposite the first panel, wherein
the control surface is configured to rotate in place supported by said casing.

33. The hearing aid according to claim 32, further comprising:
a covering configured to externally cover the first panel and the second panel of said casing.

34. The hearing aid according to claim 33, wherein
the covering includes a protrusion mating with a depression in the casing, the protrusion mated with the depression defining a rotation axis, and
the casing is configured to rotate around said rotation axis relative to the covering.

35. The hearing aid according to claim 34, wherein
the rotation axis is located at a first distal end of the casing, and
the control surface is located at a second distal end of the casing, opposite from the first distal end.

* * * * *